US006575604B2

(12) United States Patent
Liu

(10) Patent No.: US 6,575,604 B2
(45) Date of Patent: Jun. 10, 2003

(54) BULB HOLDER FOR DECORATIVE LAMP

(76) Inventor: Yu-Peng Liu, 2nd Floor, No.51, Lane 629, Nei-Hu Road, Sec. 1, Nei-Hu Dist, Teipei (TW)

( * ) Notice: Subject to any disclaimer, the term of this patent is extended or adjusted under 35 U.S.C. 154(b) by 14 days.

(21) Appl. No.: 10/042,223

(22) Filed: Jan. 11, 2002

(65) Prior Publication Data

US 2002/0149937 A1 Oct. 17, 2002

(30) Foreign Application Priority Data

Apr. 17, 2001 (CN) ..... 90205963

(51) Int. Cl.[7] ..... F21S 13/10

(52) U.S. Cl. ..... 362/431; 362/363; 362/370; 362/414; 362/429; 362/430

(58) Field of Search ..... 362/363, 370, 362/414, 424, 430, 431

(56) References Cited

U.S. PATENT DOCUMENTS 2,339,385 A * 1/1944 Dupler ..... 362/363
3,336,474 A * 8/1967 Leibl ..... 362/363
4,477,864 A * 10/1984 Van Duyn et al. ..... 362/363
5,722,758 A * 3/1998 Huang ..... 362/548
5,951,153 A * 9/1999 Favela ..... 362/410
6,224,241 B1 * 5/2001 Oswald ..... 362/368

* cited by examiner

*Primary Examiner*—Sandra O'Shea
*Assistant Examiner*—Ismael Negron
(74) *Attorney, Agent, or Firm*—Dennison, Schultz & Dougherty

(57) ABSTRACT

A bulb holder for decorative lamp includes a main body that is connected to a frame of the lamp for holding a plurality of bulbs and has retaining spaces equally spaced at a lower side thereof, and a tubular connector that includes a lower tube portion that may be differently sized, and a horizontal flange portion. The flange portion is provided along an outer edge with equally spaced teeth corresponding to the retaining spaces on the main body. By aligning the tube portion with a central mounting hole of the main body and turning the tubular connector to move the teeth into the retaining spaces, the tubular connector is detachably connected to the lower side of the main body. By connecting the main body to a tubular connector having a differently sized tube portion, the decorative lamp may be conveniently mounted onto a differently sized post via the tube portion.

1 Claim, 5 Drawing Sheets

BULB HOLDER FOR DECORATIVE LAMP

BACKGROUND OF THE INVENTION

The present invention relates to a bulb holder for a decorative lamp, and more particularly to a bulb holder that allows easy replacement of burned-out bulbs and free mounting of the decorative lamp to different locations.

A conventional decorative lamp usually includes a decoration, such as a doll, supported on a frame, and a bulb holder connected to a lower inner side of the frame for holding a plurality of spaced bulbs thereon, so that the bulbs alternately lighten and extinguish. The bulb holder is provided with a central mounting hole for engaging with, for example, a post, so as to mount the decorative lamp onto the post. The conventional bulb holder for the decorative lamp has the following disadvantages due to the central mounting hole that has a fixed size:

1. The bulb holder, due to the fixedly sized mounting hole, could be used with only one size of post matching with the mounting hole of the bulb holder. In the event the decorative lamp is to be mounted onto a differently sized post, or from a Christmas tree to a post of a fence, or onto a garden lamp, it would be difficult to quickly change the bulb holder to another one having a suitably sized mounting hole.
2. In the event of connecting the bulb holder to a post mismatching with the mounting hole on the bulb holder, a bonding material, such as an adhesive, would be needed to prevent the bulb holder and the decorative lamp from swinging on and falling off the post. However, the bonding material also prevents easy replacement of burned-out bulbs.

It is therefore tried by the inventor to develop an improved bulb holder for decorative lamp to eliminate the drawbacks existing in the above-described conventional bulb holder.

SUMMARY OF THE INVENTION

A primary object of the present invention is to provide a bulb holder for decorative lamp that enables quick replacement of the decoration of the lamp with another one.

Another object of the present invention is to provide a bulb holder for decorative lamp that allows easy change of place for fixing the decorative lamp.

A further object of the present invention is to provide a bulb holder for decorative lamp that enables easy replacement of burned-out bulbs.

To achieve the above and other objects, the bulb holder for decorative lamp according to the present invention mainly includes a main body connected to a frame of the decorative lamp through engagement of projections provided along an outer edge of the main body with insertion slots provided on the lamp frame. The main body also includes a central mounting hole and a plurality of bulb holes located around the mounting hole for each holding a bulb. The bulb holder of the present invention is characterized in retaining spaces equally spaced at a lower side of the main body along a peripheral edge of the central mounting hole, and a tubular connector including a lower tube portion that may be differently sized, and a horizontal flange portion. The flange portion is provided along an outer edge with equally spaced teeth corresponding to the retaining spaces on the main body. By aligning the tube portion with the central mounting hole on the main body and turning the tubular connector to move the teeth into the retaining spaces, the tubular connector is detachably connected to the lower side of the main body. By connecting the main body to a tubular connector having a differently sized tube portion, the decorative lamp may be conveniently mounted onto a differently sized post via the tube portion. And, by disengaging the main body from the tubular connector, the decorative lamp may be easily removed from the post and replaced with another decoration, and any burned-out bulb may be replaced with a good one.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
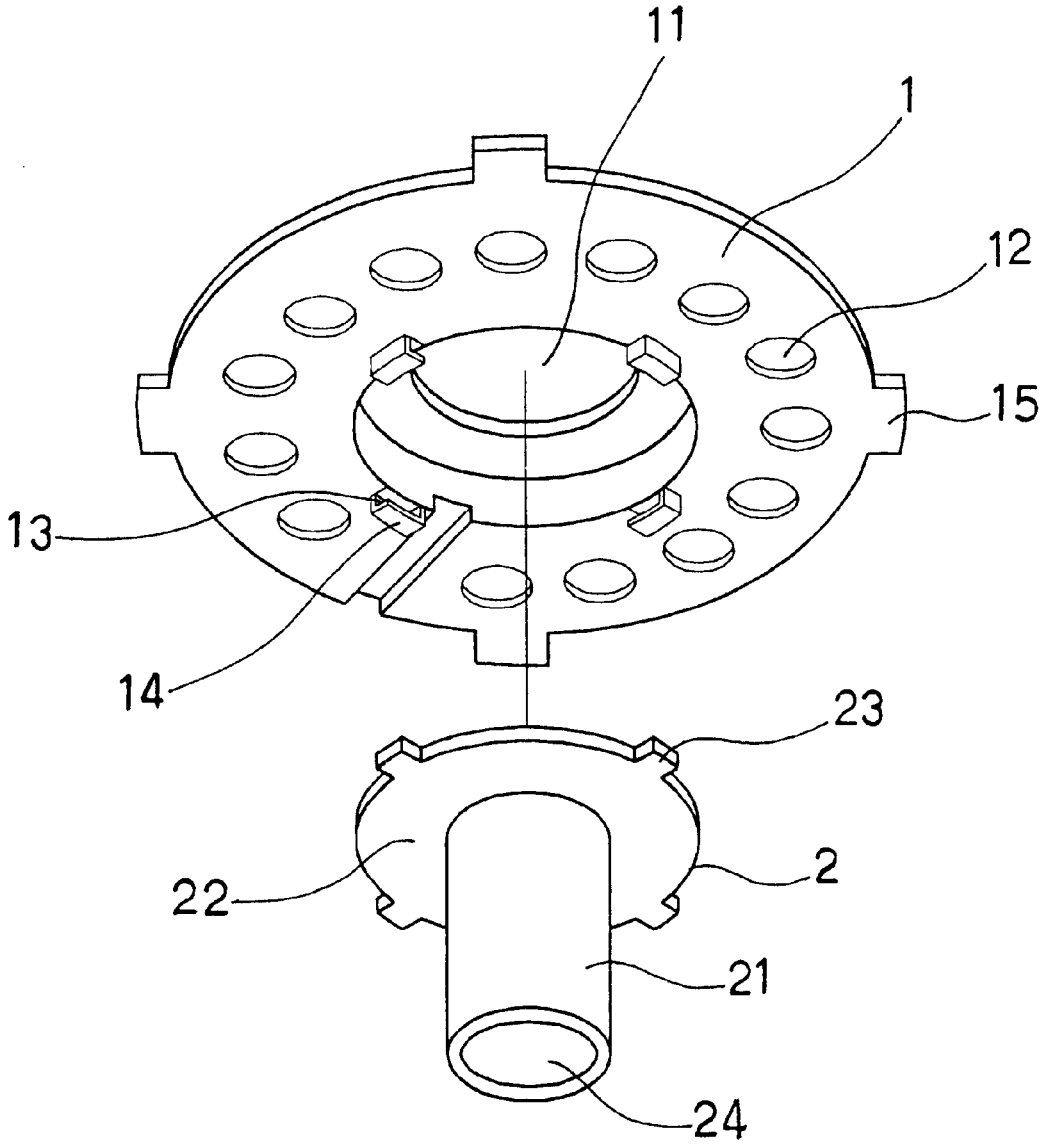
FIG. 1 is an exploded perspective view of a bulb holder for decorative lamp according to the present invention.
Figure 2:
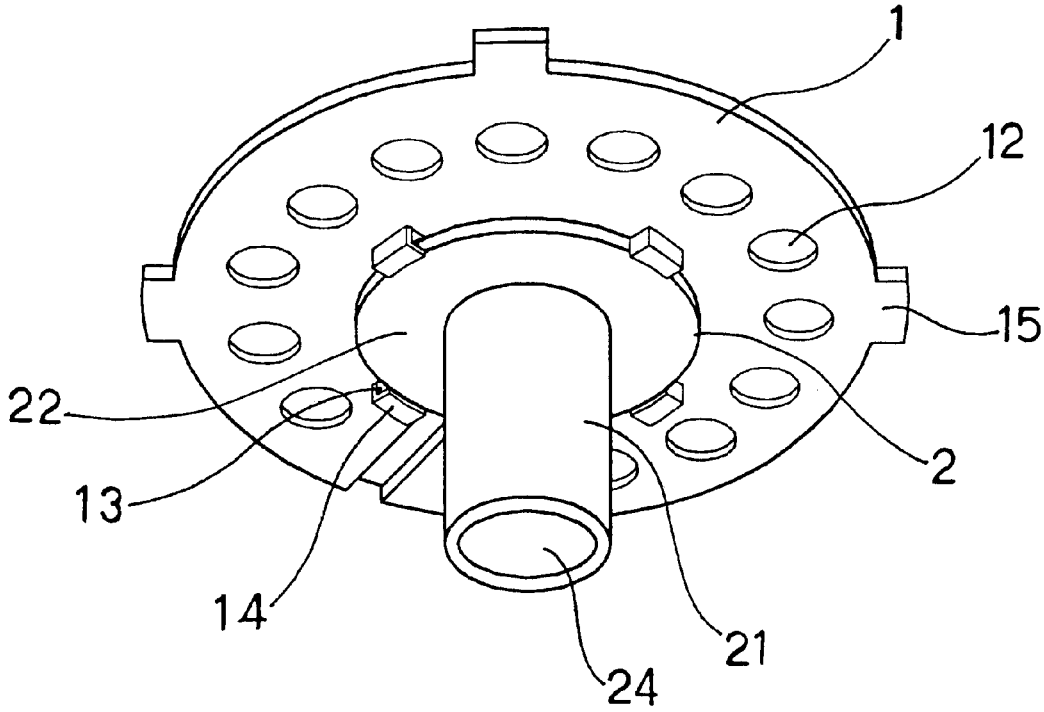
FIG. 2 is an assembled perspective view of the bulb holder for decorative lamp of FIG. 1.
Figure 4:
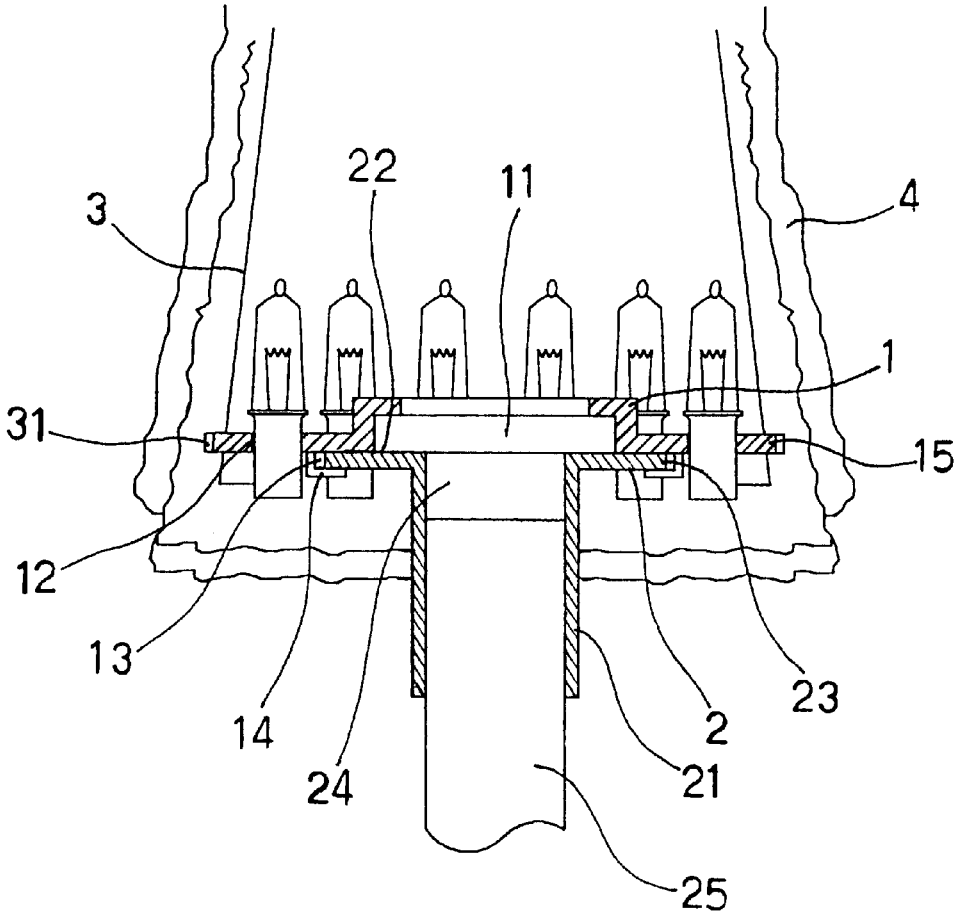
FIG. 4 is a sectioned side view of the bulb holder of the present invention connected to a decorative lamp.

Please refer to FIGS. 1, 2 and 4. The present invention relates to a bulb holder for a decorative lamp. The decorative lamp usually includes a decoration 4, such as a doll, supported on a frame 3. The bulb holder mainly includes a main body 1 and a tubular connector 2.

The main body 1 is provided along an outer edge with radially extended and circumferentially spaced projections 15 for engaging with insertion slots 31 formed on the frame 3 that supports the decoration 4 over it. The main body 1 includes a central mounting hole 11, and an area of the main body 1 surrounding the central mounting hole 11 is formed of a plurality of spaced bulb holes 12. The main body 1 is characterized in a plurality of equally spaced retaining spaces 13 provided at a lower side of the main body 1 along a peripheral edge of the central mounting hole 11. In a preferred embodiment of the present invention, there are four equally spaced retaining spaces 13, each of which is formed by a curved member 14 having an L-shaped cross section and downward extended from the peripheral edge of the central mounting hole 11.

The tubular connector 2 includes a lower hollow tube portion 21 and an upper flange portion 22 horizontally and radially extended from an upper end of the tube portion 21. The upper flange portion 22 is provided along a peripheral edge with equally spaced teeth 23. The number of the teeth 23 is the same as that of the retaining spaces 13. The tube portion 21 defines a fixing hole 24 that may be differently sized.

Figure 3:
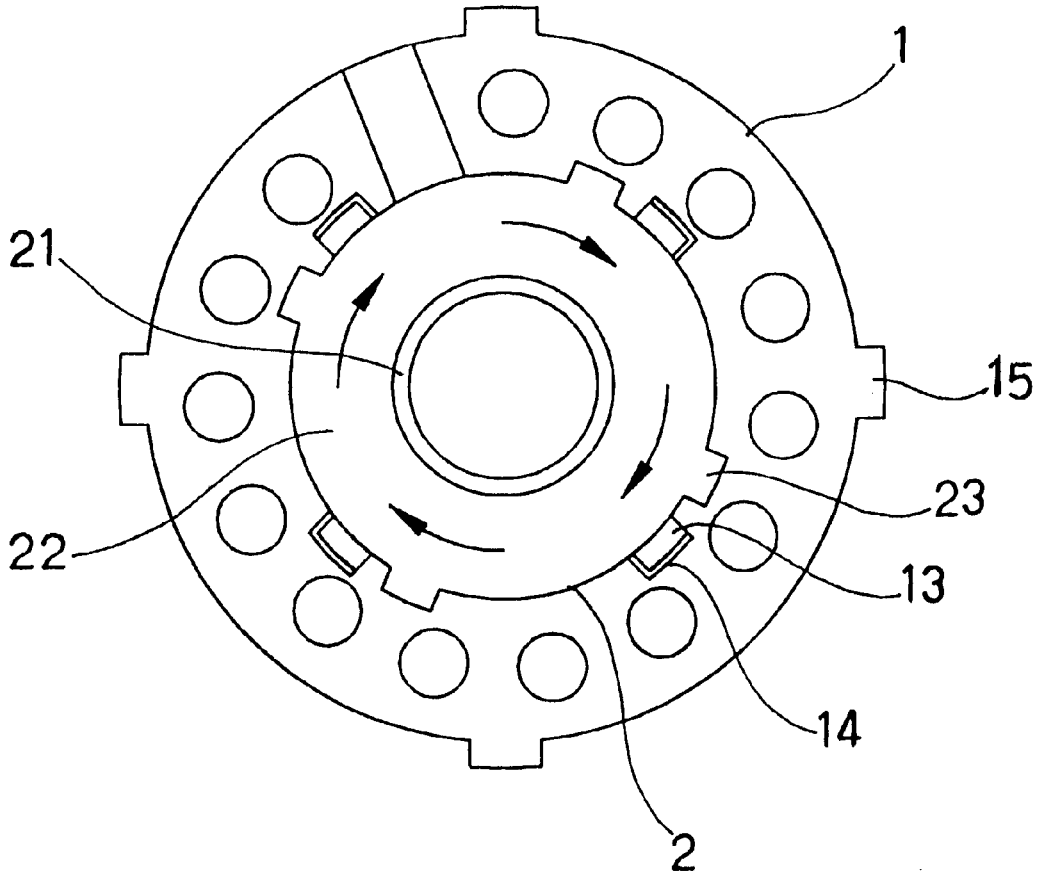
FIG. 3 is a bottom plan view showing the manner of assembling the bulb holder of the present invention.
Figure 5:
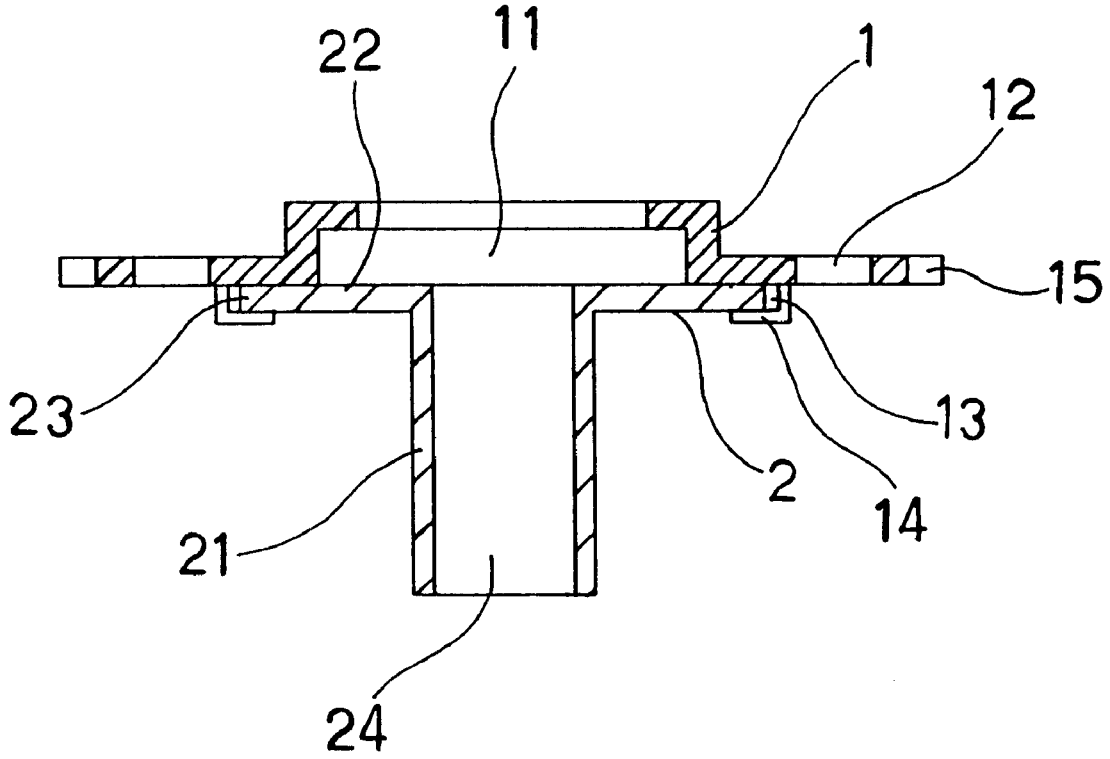
FIG. 5 shows a main body of the bulb holder of FIG. 1 is connected to a tubular connector, a tube portion of which has a size different from that of the tubular connector of FIG. 1.

As can be seen from FIGS. 3, 4 and 5, the tubular connector 2 could be detachably connected to the main body 1 simply by aligning the tube portion 21 of the tubular connector 2 with the central mounting hole 11 of the main body 1 with each tooth 23 located between two adjacent curved members 14, and turning the tubular connector 2 to move the teeth 23 into the retaining spaces 13 defined by the curved members 14. The fixing hole 24 defined by the lower hollow tube portion 21 may be engaged with a post 25 of a fence or of a garden lamp to mount the decorative lamp onto the post 25. In the case of a differently sized post 25, it is possible to connect the main body 1 to another tubular connector 2 having a differently sized tube portion 21 matching with the post 25 for firmly connecting the decorations 4 to the differently sized post 25. That is, a decorative lamp formed from the decoration 4 and the bulb holder of the present invention could always be firmly mounted onto any post simply by connecting the main body 1 of the bulb holder to a tubular connector 2 having a tube portion 21 matching with the post. The same one decorative lamp could therefore be used at different places as desired.

With the freely connectable and detachable tubular connector 2, the bulb holder of the present invention allows the frame 3 and accordingly the decoration 4 to always firmly connect to a post 25 of any size without the risk of swinging or falling. The freely connectable and detachable tubular connector 2 of the bulb holder of the present invention also allows easy and convenient replacement of a burned-out bulb or the decoration 4 with another one by turning the main body 1 to detach the same from the tubular connector 2, making the decorative lamp more practical for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A bulb holder for a decorative lamp formed from a decoration supported on a frame, comprising:

a main body being provided along an outer edge with radially spaced and horizontally extended projections for engaging into insertion slots provided on said frame of said decorative lamp so as to be connected to a lower inner side of said frame, said main body also being provided with a central mounting hole, a plurality of bulb holes spaced around said central mounting hole, and a predetermined number of L-shaped curved members downward extended from and equally spaced along a peripheral edge of said central mounting hole to each define a retaining space; and a tubular connector having a lower tube portion defining a fixing hole, a size of which may be differently designed, and an upper flange portion horizontally extended from an upper end of said tube portion, said flange portion being provided along an outer edge with equally spaced teeth, a number of which being the same as that of said L-shaped curved members on said main body, and said tubular connector being detachably connected to said main body by aligning said tube portion with said central mounting hole with each said tooth located between two said curved members adjacent to each other, and turning said tubular connector to move said teeth into said retaining spaces;

whereby said decorative lamp could be mounted onto a post of any size simply by connecting said main body of said bulb holder to a tubular connector having a tube portion matching with said post.

* * * * *